United States Patent [19]

Carabateas

[11] Patent Number: 4,493,263

[45] Date of Patent: Jan. 15, 1985

[54] BALLISTIC PROPULSION SYSTEM

[76] Inventor: Eustratios N. Carabateas, 10, Chlois Str., Kiffisia, Greece

[21] Appl. No.: 426,613

[22] Filed: Sep. 29, 1982

[30] Foreign Application Priority Data

Nov. 16, 1981 [GR] Greece ..... 66532

[51] Int. Cl.[3] ..... F42B 27/00; F42B 13/28

[52] U.S. Cl. ..... 102/483; 42/1 F; 102/376; 102/490

[58] Field of Search ..... 102/483, 473, 482, 490, 102/374, 375, 376; 42/1 F

[56] References Cited

U.S. PATENT DOCUMENTS

| | | | |
|---|---|---|---|
| 2,657,630 | 11/1953 | Blacker . | |
| 3,024,729 | 3/1962 | Kluge . | |
| 3,243,909 | 5/1966 | Kotikov | 102/483 |
| 3,882,780 | 5/1975 | Gawlick et al. | 102/483 |
| 4,010,688 | 3/1977 | Smith et al. | 102/483 |
| 4,160,414 | 7/1979 | Stockman et al. | 102/483 |

FOREIGN PATENT DOCUMENTS

| | | | |
|---|---|---|---|
| 2003505 | 1/1970 | Fed. Rep. of Germany . | |
| 492151 | 7/1919 | France . | |
| 492504 | 7/1919 | France | 102/483 |
| 1363344 | 5/1964 | France . | |
| 1508558 | 11/1967 | France . | |
| 10219 | of 1914 | United Kingdom . | |

*Primary Examiner*—Charles T. Jordan
*Assistant Examiner*—Ted L. Parr
*Attorney, Agent, or Firm*—Darby & Darby

[57] ABSTRACT

A ballistic propulsion system of the type used to launch grenades from a rifle. The system includes a housing having a propulsion tail protion with a ballistic cartridge mounted inside and a nozzle with a rear opening having a diameter $d_1$. This opening is surrounded by an annular seating surface having an outside diameter $d_2$, which is larger than $d_1$. A diaphragm is mounted in engagement with the seating surface, and the diaphragm is designed to remain intact when pressures generated by a ballistic cartridge are asserted on a surface area of diameter $d_1$ or less, but to break away from the propulsion tail when the gas pressure is applied to a surface area having a diameter $d_2$ or greater. As a result, the diaphragm remains intact when the projectile is first launched by gas pressure generated by a ballistic cartridge within the rifle, but the diaphragm breaks away when the ballistic cartridge inside the propulsion tail builds up sufficient pressure. The ballistic cartridge within the ballistic tail is fired at a predefined time after the initial launch, in order to increase the range of the projectile. Firing of the ballistic cartridge inside the housing is achieved by means of a sliding, dual-action mechanism, which is spring loaded and has a firing pin at either end. Upon initial launch, the lower firing pin is driven downward by inertia to ignite a delayed charge for firing the ballistic cartridge. The upper firing pin fires the grenade, either upon impact or under the influence of gas pressure generated by the ballistic cartridge.

8 Claims, 3 Drawing Figures

BALLISTIC PROPULSION SYSTEM

The present invention relates generally to ballistic propulsion systems and, more particularly, concerns an improved propulsion system and fuse for rifle grenades and similar projectiles.

BACKGROUND OF THE INVENTION

The rifle grenade is a weapon which is fired with a common rifle. Its head is a grenade, either antipersonnel or antitank or other type (e.g. smoke grenade, etc.). The acceleration of this grenade is realized with a ballistic cartridge in the rifle, which is usually a blank and of the same caliber as the rifle.

The charge weight of this cartridge must not exceed certain limits to avoid the danger of early wear of the rifle barrel. As the weight of this charge is thus limited and the weight of these grenades is much larger than the weight of the bullet of a common cartridge of the rifle, the firing range of these rifle grenades is very limited (usually between 200 and 300 meters) and is not in a straight trajectory, but has a firing angle of about 45°, which attains the maximum shooting distance.

Broadly, it is an object of the present invention to overcome the disadvantages of prior art ballistic systems, particularly those of the type used to fire rifle grenades.

It is a more specific object of the invention to increase the range of ballistic systems of the type used to propel rifle grenades.

It is another object of the present invention to improve the target aiming capability of ballistic systems of the type used to propel rifle grenades.

It is also an object of the present invention to achieve the foregoing improvements to ballistic systems without a significant increase in their cost, while preserving the reliability of such systems in use.

In accordance with one aspect of the present invention, the propulsion system, also referred to as a "propulsion tail" for a load such as a rifle grenade is provided with a main body that includes an extra blank ballistic cartridge, which is fired after the load (e.g. a rifle grenade) has been shot away from the rifle.

This delayed firing is achieved with the help of a special double firing mechanism which can have many other applications such as in the construction of time fuses of artillery shells or other ballistic devices, without the use of mechanical timing mechanisms and such.

This double firing mechanism serves a dual purpose: first, for the firing of the ballistic cartridge in the propulsion tail of the rifle grenade through a firing delay column; and second, for the explosion of the grenade either directly upon its hitting on a solid surface or through another delay column for its explosion after a certain specified time of flight.

In a preferred embodiment described here, the additional blank ballistic cartridge is illustrated in use in the tail tube of a rifle grenade, and a preferred construction and method of operation of the double firing mechanism are described. However, the description is merely exemplary and is not intended to limit the scope of the claimed invention.

The foregoing brief description, as well as further objects, features and advantages of the present invention will be understood more completely from the following detailed description of a presently preferred but, nonetheless, illustrative embodiment in accordance with the present invention, with reference being had to the accompanying drawing, wherein.

DETAILED DESCRIPTION

Figure 1:
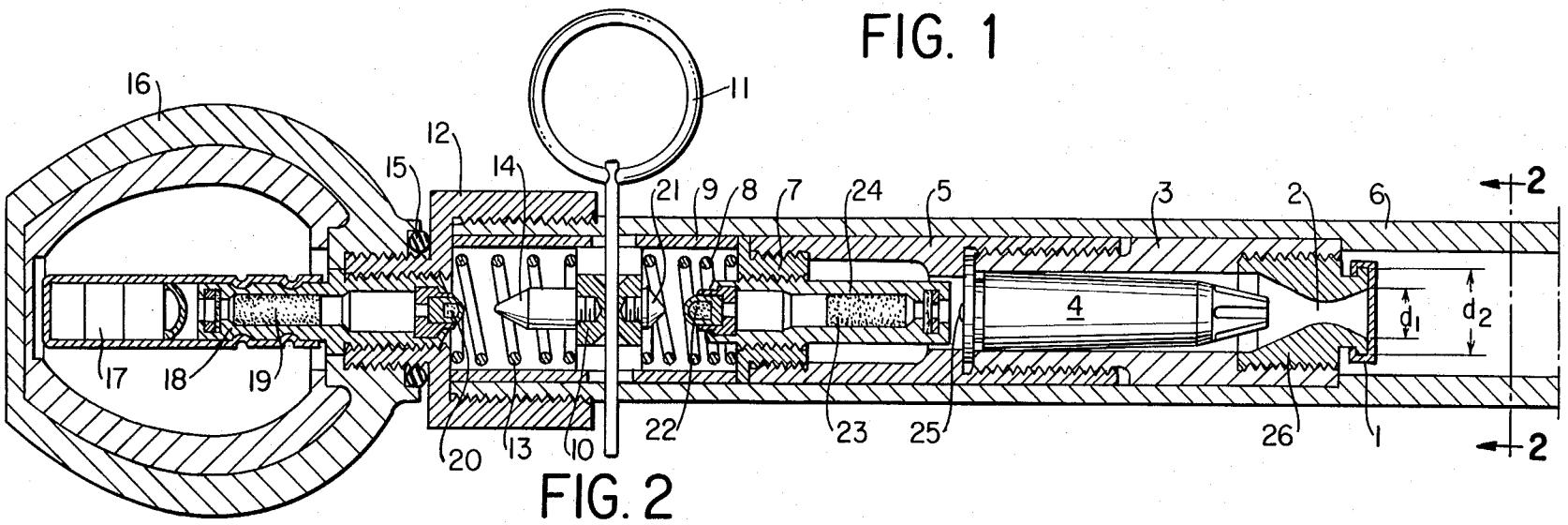
FIG. 1 illustrates the front portion of a propulsion system embodying the present invention, the system being shown in longitudinal section with a grenade mounted at the front thereof.
Figure 2:
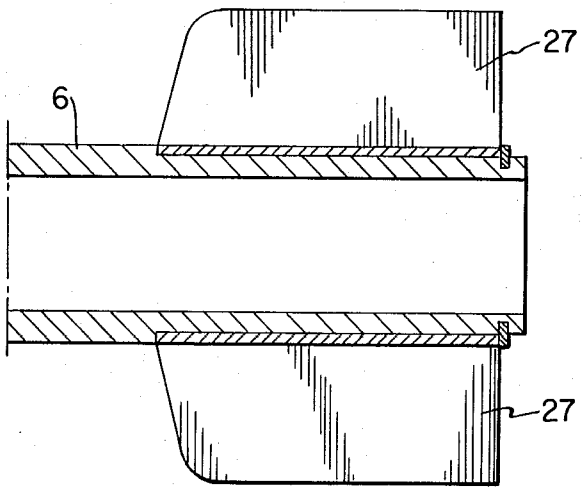
FIG. 2 illustrates the rear portion of the propulsion system of FIG. 1, similarly shown in longitudinal section.

FIGS. 1 and 2 illustrate a propulsion tail assembly embodying the present invention. The propulsion tail has a main tubular body 6 which terminates at its rear in a plurality of stabilizing fins 27, and a grenade 16 is shown in its mounted position at the front of the propulsion tail.

The tube 6 of the propulsion tail has in its front part the firing system which consists of a sliding body 10, two firing pins 14 and 21 and two springs 8 and 13.

It also has the safety pin 11 which prevents the functioning of the firing system and is removed just before shooting.

In the front part of the tube 6 of the propulsion tail there is also a cylindrical part 9 through which the gas pressure is transmitted towards the head of the grenade in order to accelerate it, during the original gun firing as well as when the additional propulsion is given in flight.

The cylindrical ring 9 maintains the spacing of its two neighboring elements 7 and 12.

The element 7 serves a dual function: it is an adaptor of the body of the delay mechanism 24, which contains the column of the delay substance 23; and it is also the fitting of this delay mechanism to the element 5, which provides for the mounting of the delay to the housing 3 containing the blank ballistic cartridge 4.

The firing of the delay column is achieved by means of the firing pin 21 which, as a result of the inertia during firing, fires the primer 22. This primer transmits the firing to the delay substance 23 and through this substance, after a specified time interval, towards the primer 25 of the cartridge 4.

The housing 3 of the cartridge 4 has at its end a nozzle 2 which is closed with a special cover 1. This cover 1 is so constructed in thickness and type of material that, when it receives the pressure of the gases of the ballistic cartridge of the rifle, an unsupported area having a diameter $d_1$ is exposed on its outer surface, which area does not break, because it is small and therefore strong. On the contrary, when this cover receives the pressure of the gases of the cartridge 4 of the propulsion tail from the inside of the housing 3 it breaks near its perimeter, because the pressure is exerted on the much larger total area of the cover corresponding to a diameter $d_2$.

Figure 3:
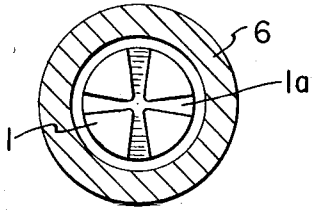
FIG. 3 is a sectional view taken along line A-B in FIG. 1 and looking in the direction of the arrows.

To achieve breaking along predetermined paths the cover 1 may have pre-cut grooves 1*a*, as shown in FIG. 3.

The front part of the tube 6 of the propulsion tail is closed with a cylindrical element 12 which has a neck of reduced diameter at the front and has three threads: one internal and one external on its small diameter, and one internal on its large diameter. The internal thread of the large diameter fits the element 12 to the tube of the propulsion tail. In the internal thread of the small diameter is fitted the delay element 18 having a delay substance 19 and a booster 17 which, together with the primer 20 form the fuse of the grenade 16. Finally, the grenade body 16 is mounted on the external thread of the small diameter of the connection element 12 through a water proof rubber ring 15 for tightness.

In operation, increased firing range of rifle grenades is initiated by removing the safety pin 11, so that the sliding body 10 with the double firing pins 14, 21 can slide freely and fire the primers 20 and 22 under the action of springs 8 and 13, as explained further below.

After the safety pin is removed, the propulsion tail of the rifle grenade is placed on top of the barrel of the rifle and is fired with the ballistic cartridge inside the rifle.

During this firing the pin 21 due to inertia fires the primer 22 through the spring 8. The primer 22 transmits the firing to the delay substance 23 which after a certain specified time of flight transmits the firing, by means of the primer 25, to the ballistic cartridge 4. This cartridge is thus fired and the resulting gases, after passing through the nozzle 2, act on the surface of diameter $d_2$ and open the cover 1. The gases then pass from the rear of the tube 6 of the propulsion tail and expand into the air.

In this way, after a certain time of flight an additional thrust is given to the rifle grenade by the additional ballistic cartridge 4 and thus a considerably greater firing range is achieved.

The primer 20 can be fired by the firing pin 14 through the action of spring 13, upon collision, due to inertia. In this case the substance 19 is a pyrotechnic substance for direct transmission of the firing. Thus, an immediate explosion of the grenade 16 takes place through the booster 17 upon its hitting on a hard surface after firing.

It is also possible, by decreasing the length of the cylindrical ring 9, to have the firing of the primer 20 by the firing pin 14 take place during the original firing. This could occur under the influence of the pressure of the gases of the rifle ballistic cartridge which would push the entire elements 5 and 3 forward, so that the firing pin 14 effectively moves towards and into the primer 20. In this case the firing from the primer 20 is transmitted, through a delay substance 19, after a certain time of flight, to the booster 17 and to the explosive material of the grenade, which explodes after a specified time delay, following the rifle firing.

Although preferred forms of the invention have been disclosed for illustrative purposes, those skilled in the art will appreciate that many modifications, additions, and substitutions are possible without departing from the scope and spirit of the invention as defined in the accompanying claims.

I claim:

1. A propulsion system and fuse for projectiles of the type launched from the end of a rifle, making use of gases generated by a ballistic cartridge within the rifle, comprising:

a housing including a propulsion tail portion having a nozzle with a rearmost opening of diameter $d_1$ and an annular seating surface with an outside diameter $d_2$ surrounding said rearmost opening;

ballistic cartridge means mounted inside said propulsion tail; and diaphragm means mounted over said rearmost opening in contact with said seating surface, said diaphragm means being constructed to break away from said propulsion tail under the pressure of gases produced by the ballistic cartridge means mounted therein over an area having a diameter at least as great as $d_2$, said diaphragm means being also constructed to remain intact under pressures produced over a surface area having a diameter at least as small as $d_1$, said diaphragm means remaining intact and being forced against said seating surface under pressures produced by the ballistic cartridge within said rifle to achieve an initial propulsion of said projectile, said diaphragm means being broken away under the influence of gases produced by the ballistic cartridge within said propulsion tail, whereby additional propulsion of said projectile is produced.

2. A propulsion system and fuse in accordance with claim 11, further including a special part for the attachment of a grenade head to the propulsion tail, comprising first and second cylindrical sectors jointed in axial alignment, the first sector having a smaller diameter than the second sector, said first and second sectors having outside and inside threads, respectively, whereby said part can be fitted, on one hand onto the propulsion tail, and on the other hand, said grenade body and a fuse can be mounted on it.

3. A propulsion system and fuse in accodance with claim 1 further comprising a firing mechanism having a sliding body within the propulsion tail which through a spring acts, under the pressure of the propulsion gases of the rifle, on the primary of the fuse of the grenade, and delay column means for firing the grenade so that it explodes after a specified time interval.

4. A propulsion system in accordance with any one of claims 2, 3 or 1 for use with an exploding weapon mounted at the front of said housing, the rear of said propulsion tail being adapted to be mounted in a rifle, said system further comprising:

actuating means slidably mounted within said body for movement between the front and rear thereof, said actuating means having firing pin means protruding from the front and rear thereof;

resilient means for biasing said actuating means in a predetermined intermediate position;

said ballistic cartridge means being mounted near the rear of said housing;

delay means mounted in said housing between said ballistic cartridge and said predetermined intermediate position; and said resilient means acting on said actuating means to position the same at a distance from said delay means and an actuating portion of said weapon, which is mounted at the front of said housing, the rear firing pin of said actuating means firing said delay means by action of inertia when said projectile is first launched, whereby the ballistic cartridge means within said housing is fired after a predefined time interval to substantially increase the range of said projectile, said front firing pin being driven forward to activate said weapon.

5. A propulsion system for a projectile of the type launched from a rifle, making use of a ballistic cartridge within the rifle, said projectile being of the type including a housing with a propulsion tail portion adapted to be mounted in said rifle and a receiving head adapted to have an exploding weapon mounted thereon, the improvement comprising:

actuating means slidably mounted within said body for movement between the front and rear thereof, said actuating means having firing pin means protruding from the front and rear thereof;

resilient means for biasing said actuating means in a predetermined intermediate position;

ballistic cartridge means mounted near the rear of said housing;

delay means mounted in said housing between said ballistic cartridge and said predetermined intermediate position; and said resilient means acting on said actuating means to position the same at a distance from said delay means and an actuating portion of said weapon, which is mounted at the front of said housing, the rear firing pin of said actuating means firing said delay means by action of inertia when said projectile is first launched, whereby the ballistic cartridge means within said housing is fired after a predefined time interval to substantially increase the range of said projectile, said front firing pin being driven forward to activate said weapon.

6. A system in accordance with claim 5, further comprising safety pin means for immobilizing said actuating means that carries the two firing pins, said safety pin means extending through said housing and said actuating means to immobilize the latter, said safety pin being removed just before launching said projectile.

7. A propulsion system and fuse in accordance with claim 5 further comprising means on said actuating means for receiving the pressure of gases generated by the ballistic cartridge within said housing, said means for receiving being driven forward under the influence of such gases to actuate said weapon.

8. A system in accordance with either claim 5 or 7 further comprising additional delay means mounted within said housing between said actuating means and said weapon, whereby said weapon is exploded at a predefined time following the striking of said front pin upon said additional delay means.

* * * * *